US010781741B2

(12) United States Patent
Eisenschenk et al.

(10) Patent No.: US 10,781,741 B2
(45) Date of Patent: Sep. 22, 2020

(54) COOLING SYSTEM AFTER ENGINE SHUT-DOWN, CYLINDER HEAD, AND METHOD FOR OPERATING A COOLING SYSTEM AFTER ENGINE SHUT-DOWN

(71) Applicant: Bayerische Motoren Werke Aktiengesellschaft, Munich (DE)

(72) Inventors: Christoph Eisenschenk, Pfaffenhofen (DE); Thomas Scheuer, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 100 days.

(21) Appl. No.: 16/037,293

(22) Filed: Jul. 17, 2018

(65) Prior Publication Data

US 2018/0320577 A1 Nov. 8, 2018

Related U.S. Application Data

(63) Continuation of application No. PCT/EP2016/079985, filed on Dec. 7, 2016.

(30) Foreign Application Priority Data

Jan. 18, 2016 (DE) ..... 10 2016 200 508

(51) Int. Cl.
*F01P 3/02* (2006.01)
*F01P 11/00* (2006.01)
(Continued)

(52) U.S. Cl.
CPC ..... *F01P 3/02* (2013.01); *F01P 3/20* (2013.01); *F01P 11/16* (2013.01); *F02B 39/005* (2013.01);
(Continued)

(58) Field of Classification Search
CPC ..... F01P 3/02; F01P 3/20; F01P 11/16; F01P 2060/10; F01P 2060/12; F01P 2070/50;
(Continued)

(56) References Cited

U.S. PATENT DOCUMENTS 3,835,822 A * 9/1974 Mickle ..... F02M 37/20 123/41.31
4,728,306 A * 3/1988 Schneider ..... F01P 3/207 123/41.02
(Continued)

FOREIGN PATENT DOCUMENTS

DE 103 18 744 A1 11/2004
DE 10 2006 053 514 A1 5/2008
(Continued)

OTHER PUBLICATIONS

German-language Search Report issued in counterpart German Application No. 10 2016 200 508.1 dated Jul. 25, 2016 with partial English translation (11 pages).
International Search Report (PCT/ISA/210) issued in PCT Application No. PCT/EP2016/079985 dated Feb. 27, 2017 with English translation (five pages).
(Continued)

*Primary Examiner* — Mark A Laurenzi
*Assistant Examiner* — Dapinder Singh
(74) *Attorney, Agent, or Firm* — Crowell & Moring LLP

(57) ABSTRACT

A cooling system after engine shut-down includes a pump, a coolant duct for a coolant, and at least one component to be cooled. The coolant duct is associated with a fuel pump. A cylinder head for an internal combustion engine and a method for operating the cooling system after engine shut-down are provided.

13 Claims, 3 Drawing Sheets

(51) Int. Cl.

| | |
|---|---|
| ***F02B 39/00*** | (2006.01) |
| ***F02M 37/14*** | (2006.01) |
| ***F01P 11/16*** | (2006.01) |
| ***F01P 3/20*** | (2006.01) |
| ***F02F 1/36*** | (2006.01) |

(52) U.S. Cl.
CPC ..... *F02F 1/36* (2013.01); *F02M 37/14* (2013.01); *F01P 2003/024* (2013.01); *F01P 2031/30* (2013.01); *F01P 2060/10* (2013.01); *F01P 2060/12* (2013.01); *F01P 2070/50* (2013.01)

(58) Field of Classification Search
CPC ..... F01P 2003/024; F01P 2031/30; F02M 37/14; F02B 39/005; F02F 1/36
USPC ..... 60/602, 605.2, 605.3
See application file for complete search history.

(56) References Cited

U.S. PATENT DOCUMENTS

| | | | | |
|---|---|---|---|---|
| 10,023,025 | B2 | 7/2018 | Richter et al. | |
| 2005/0188943 | A1* | 9/2005 | Gonzalez | F02B 39/005 123/245 |

FOREIGN PATENT DOCUMENTS

| | | | |
|---|---|---|---|
| DE | 10 2010 015 107 | A1 | 10/2011 |
| DE | 10 2014 201 167 | A1 | 7/2015 |
| DE | 11 2015 000 036 | T5 | 11/2015 |
| EP | 1 923 548 | A2 | 5/2008 |
| JP | 2008-202441 | A | 9/2008 |

OTHER PUBLICATIONS

German-language Written Opinion (PCT/ISA/237) issued in PCT Application No. PCT/EP2016/079985 dated Feb. 27, 2017 (five pages).

* cited by examiner

COOLING SYSTEM AFTER ENGINE SHUT-DOWN, CYLINDER HEAD, AND METHOD FOR OPERATING A COOLING SYSTEM AFTER ENGINE SHUT-DOWN

CROSS REFERENCE TO RELATED APPLICATIONS

This application is a continuation of PCT International Application No. PCT/EP2016/079985, filed Dec. 7, 2016, which claims priority under 35 U.S.C. § 119 from German Patent Application No. 10 2016 200 508.1, filed Jan. 18, 2016, the entire disclosures of which are herein expressly incorporated by reference.

BACKGROUND AND SUMMARY OF THE INVENTION

The invention relates to a cooling system after engine shut-down, a cylinder head for an internal combustion engine of a motor vehicle and a method for operating a cooling system after engine shut-down.

For reasons of fuel efficiency, modern internal combustion engines with direct fuel injection have to be operated as hot as possible in order to reduce the friction inside the engine. However, the effect of this is that the high-pressure fuel pump operated for example with the exhaust camshaft also becomes heated, since the latter is provided in the region of the internal combustion engine. For example, the high-pressure fuel pump may be arranged by means of a holding fixture directly on the cylinder head of the internal combustion engine.

Under certain circumstances, the high-pressure fuel pump may heat up very intensively, as a result of which very hot regions may arise locally precisely during a hot shut-down of the internal combustion engine, which lead to the fuel in the high-pressure fuel pump evaporating. This occurs particularly with readily volatile petrol winter fuels, which already boil at approximately 100° C. with fuel pressures of approximately 5 to 6 bar relative. Upon evaporation of the fuel, bubbles then arise which adversely affect the fuel delivery of the high-pressure fuel pump and, on the high-pressure side of the high-pressure fuel pump, lead to an insufficient fuel pressure and/or fuel delivery volume when an attempt is made to restart the internal combustion engine. The effect of this may be that the engine does not start directly or dies again shortly after starting and can only be successfully started and operated again when the system has cooled down and the fuel in the low-pressure region of the fuel system is again sufficiently liquid, so that the high-pressure fuel pump can again deliver sufficiently liquid fuel and can thus build up a high fuel pressure again in the high-pressure region of the fuel system.

Cost-intensive measures are known from the prior art in order to solve the aforementioned problem. For example, the pre-feed pressure is increased, so that the boiling temperature of the fuel in the low-pressure region of the fuel system is raised. For this purpose, the fuel system must be correspondingly designed for higher pressures, which causes higher costs. An alternative option is to use active water cooling, with which the high-pressure fuel pump is actively cooled. High costs also arise here, since additional components are incorporated, which also require space. And, space usually is not available in an engine compartment of a motor vehicle.

The problem of the present invention is to cool a fuel pump in a straightforward manner, cost effectively and efficiently.

According to the invention, the problem is solved by a cooling system after engine shut-down, with a pump, a coolant duct for a coolant and at least one component to be cooled, wherein the coolant duct is assigned to a fuel pump.

The basic idea of the invention is to design a cooling system after engine shut-down such that the cooling system after engine shut-down, which is in any case present, is used to prevent overheating of the fuel pump if the motor vehicle is shut down hot. Accordingly, no additional costs for two separate cooling systems arise, since not every individual component of the internal combustion engine is cooled with a separately constituted cooling system after engine shut-down, but rather at least two components share a common cooling system after engine shut-down. It has emerged that the cooling capacity is sufficiently high, so that a plurality of components can be cooled by a common cooling system. The fuel pump is, for example, a high-pressure fuel pump.

In particular, the at least one component to be cooled is an exhaust gas turbocharger. Apart from the fuel pump, the exhaust gas turbocharger is also cooled. The exhaust gas turbocharger is usually cooled with a water-glycol mixture as coolant. The cooling system used to cool the exhaust gas turbocharger can be redesigned such that it simultaneously cools the fuel pump in order to ensure that the fuel does not evaporate.

The at least one component to be cooled can be a cylinder head. The cylinder head is connected directly or indirectly to the fuel pump. Components of the cylinder head can thus be cooled simultaneously.

Precisely during the cooling of the exhaust gas turbocharger, it must be ensured that the cooling of the exhaust gas turbocharger is also maintained during the hot shut-down of the engine, in order to eliminate temperature damage to the exhaust gas turbocharger. This cooling after engine shut-down can accordingly be used for the fuel pump, so that evaporation of the fuel is prevented even with a hot shut-down of the internal combustion engine.

The cooling after engine shut-down is implemented by the fact that a pump, in particular an electric main water pump or a separate electric auxiliary pump, is provided. The pump delivers the coolant through the coolant duct, which is assigned to the fuel pump and the exhaust gas turbocharger and/or the cylinder head as components to be cooled or as a component to be cooled.

Alternatively or in addition, other components of the internal combustion engine which are cooled after engine shut-down can also be part of the cooling system after engine shut-down and share a common coolant duct and a pump.

According to one aspect, the coolant duct extends through the fuel pump, for example through its housing. It is thus ensured that the fuel pump and the fuel present therein are cooled essentially directly, since the coolant flows directly through the fuel pump, in particular through a housing region of the fuel pump. Any heat transmission losses can thus be minimized.

Alternatively or in addition, provision can be made such that the coolant duct extends through a holding fixture of the fuel pump. This thus prevents heat passing from the engine block or cylinder head through the holding fixture to the fuel pump. It is advantageous here that the fuel pump can easily be replaced without a cooling circuit having to be disconnected and reinstalled again.

According to one aspect, a coolant cooler is provided in the cooling system after engine shut-down at least piecewise parallel to or in series with the coolant duct. Particularly efficient cooling can thus be achieved, in particular of the fuel pump and of the components to be cooled. The coolant cooler produces an even greater cooling effect.

In particular, a fan can be assigned to the cooling system after engine shut-down. The fan can be used to further increase the additional cooling effect of the coolant cooler.

The problem of the invention is also solved by a cylinder head for an internal combustion engine, through which a part of the coolant duct of a cooling system after engine shut-down of the aforementioned kind extends. The cylinder head thus comprises a region of the coolant duct, so that the cylinder head serves to cool components to be cooled and/or the fuel pump.

In particular, the fuel pump is fitted to the cylinder head by way of a holding fixture, wherein the coolant duct is located in the vicinity of the region in which the holding fixture for the fuel pump on the cylinder head is arranged. It is thus ensured that the fuel pump is cooled indirectly, since the coolant flows directly in the connecting region of the fuel pump through the cylinder head constituted separately therefrom. "Indirect cooling" herein means that a heat transfer from a hot component to the fuel pump is prevented. A replacement of the fuel pump can easily be carried out, since no coolant lines run through the fuel pump itself. Furthermore, a uniform interface for different fuel pumps is thus created, via which interface the correspondingly connected fuel pump can be cooled.

Furthermore, the invention provides a method for operating a cooling system after engine shut-down of the aforementioned kind, wherein the operation of the pump of the cooling system after engine shut-down takes place with the aid of a determined demand-based control. It is thus possible to optimize the cooling by means of the cooling system after engine shut-down, since this takes place in a demand-based manner. For this purpose, the maximum individual cooling requirement in each case of the respective components to be cooled can be met by the cooling system after engine shut-down. The energy consumption required by the cooling system after engine shut-down can thus be minimized in a demand-based manner.

One aspect makes provision such that the control of the pump is determined from known variables of an engine control unit, in particular by means of software for determining the minimum cooling requirement of the at least one component to be cooled and of the fuel pump. It is thus readily possible to implement the demand-based control of the pump, since no additional values have to be determined beforehand.

Furthermore, the cooling system after engine shut-down can comprise a fan, the operation whereof takes place with the aid of a determined control. The fan has an influence on the cooling capacity, for which reason a different control of the fan can bring about a correspondingly different cooling capacity.

In particular, the control of the fan is determined from known variables of an engine control unit, in particular by means of software for determining the minimum cooling requirement of the at least one component to be cooled and of the fuel pump. It is thus readily possible to implement the demand-based control of the fan, since no additional values have to be determined beforehand.

The known variables for determining the control of the pump and/or the fan are for example variables of the current engine operation, e.g. current coolant temperature, current oil temperature, current engine power averaged over a specific period and/or current ambient temperature.

According to a further aspect, at least one switchable actuator is assigned to the cooling system after engine shut-down, said switchable actuator being switched during the operation of the cooling system after engine shut-down in such a way that the best possible cooling effect for the at least one component to be cooled and/or the fuel pump is achieved. It is thus possible to switch the cooling capacity in a demand-based manner.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
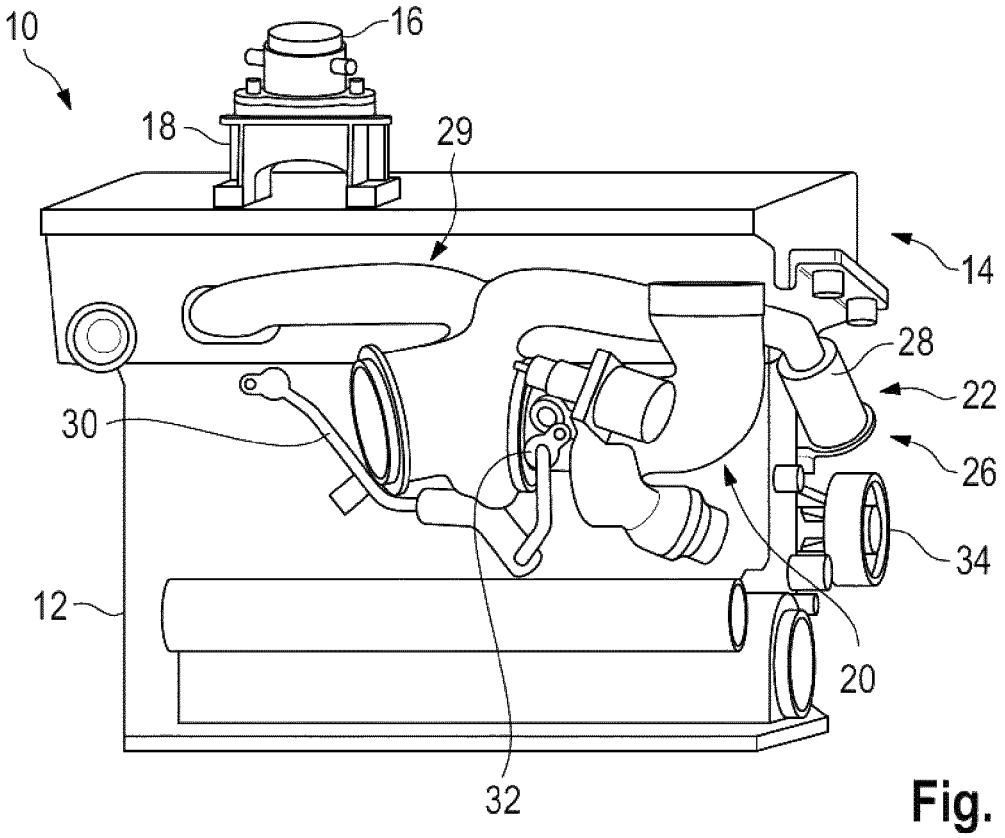
FIG. 1 is a perspective view of an internal combustion engine with a cooling system after engine shut-down according to an embodiment of the invention.

FIG. 1 shows an internal combustion engine 10, which includes an engine block 12 and a cylinder head 14, which is coupled with engine block 12.

Internal combustion engine 10 also includes a fuel pump 16, which in the embodiment shown is fastened to cylinder head 14 by way of a holding fixture 18 in the form of a pump carrier. Fuel pump 16 can be a high-pressure fuel pump. Moreover, internal combustion engine 10 includes an exhaust gas turbocharger 20, which is a component of internal combustion engine 10 that is to be cooled.

Internal combustion engine 10 further includes a cooling system 22 after engine shut-down, with which exhaust gas turbocharger 20 and fuel pump 16, amongst other things, are cooled, as will be explained below.

Cooling system 22 after engine shut-down is in particular constituted such that the components of internal combustion engine 10 to be cooled are still cooled when internal combustion engine 10 is shut down hot.

Figure 3:
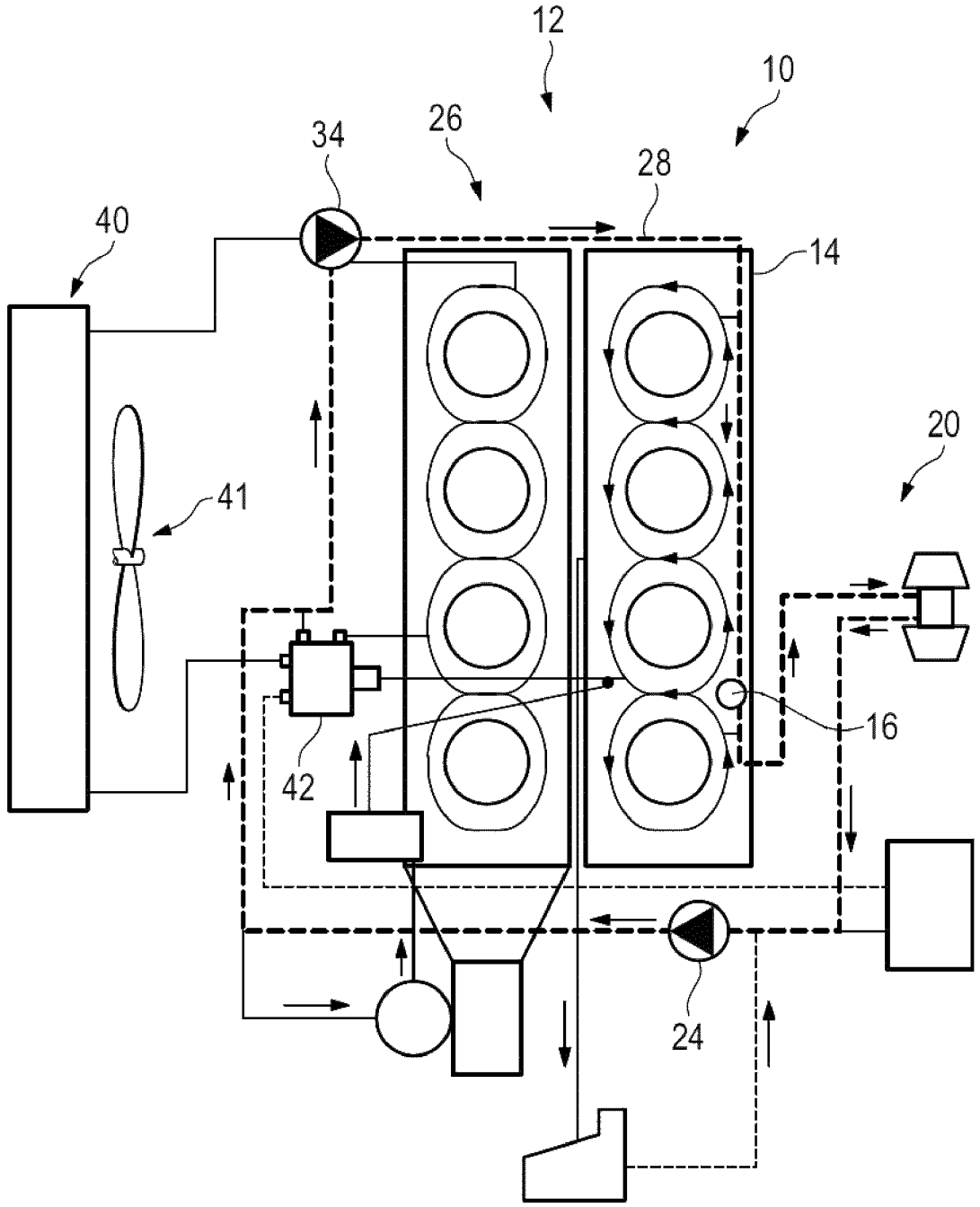
FIG. 3 is a schematic overview of a cooling system after engine shut-down according to an embodiment of the invention in the case of an internal combustion engine according to a first embodiment.

For this purpose, cooling system 22 after engine shut-down has its own pump 24, which in the embodiment shown is constituted as an electric auxiliary pump (see FIG. 3). Alternatively, a non-electric pump can be provided.

Furthermore, cooling system 22 after engine shut-down comprises a coolant duct 26 for a coolant, which coolant duct extends from pump 24 through cylinder head 14 up to exhaust gas turbocharger 20.

Coolant duct 26 accordingly comprises a coolant feed line 28, which extends from pump 24 into cylinder head 14. Proceeding from coolant feed line 28, coolant duct 26 runs along a region 29 inside cylinder head 14 that is assigned to holding fixture 18 of fuel pump 16. The coolant (K) flowing through coolant duct 26, which is represented by the arrow, reduces the heat (W) transmitted by internal combustion engine 10 to holding fixture 18, which is also represented by corresponding arrows. The heat input of internal combustion engine 10 into holding fixture 18 and fuel pump 16 connected thereto is therefore greatly reduced, for which reason the fuel present in fuel pump 16 is not heated so intensively that it could boil.

After the coolant has flowed through cylinder head 14, the coolant flows into an exhaust gas turbocharger feed line 30, which in the embodiment shown is located at the side of engine block 12 and leads to an entry 32 of exhaust gas turbocharger 20. Exhaust gas turbocharger 20 is therefore cooled by the same coolant that has previously cooled fuel pump 16.

Internal combustion engine 10 also includes a water pump 34, driven mechanically for example.

As a result of provided pump 24, a cooling system after engine shut-down is created which is also still active when internal combustion engine 10 is switched off during a hot shut-down or is still running. Accordingly, the coolant is still conveyed through coolant duct 26 when an internal combustion engine is shut down hot, in order to cool fuel pump 16 and exhaust gas turbocharger 20. In the case of an electric pump as pump 24, the cooling after engine shut-down can accordingly take place independently of the operation of the internal combustion engine.

The coolant used to cool exhaust gas turbocharger 20 is therefore first diverted into cylinder head 14, so that the coolant cools cylinder head 14 or reduces the heat input, particularly into region 29 in which holding fixture 18 with cooling pump 16 is arranged. To this extent, fuel pump 16 and the fuel contained therein is cooled indirectly, which effectively prevents the fuel from evaporating and vapor bubbles from forming, which can lead to poor starting behavior of internal combustion engine 10. After the cooling of fuel pump 16, exhaust gas turbocharger 20 is cooled by the same coolant.

As an alternative to the embodiment shown, wherein coolant duct 26 indirectly cools fuel pump 16, provision can also be made such that fuel pump 16 has in its housing an interface to which coolant duct 26 can be connected, so that coolant duct 26 would run at least partially through fuel pump 16 itself.

Figure 4:
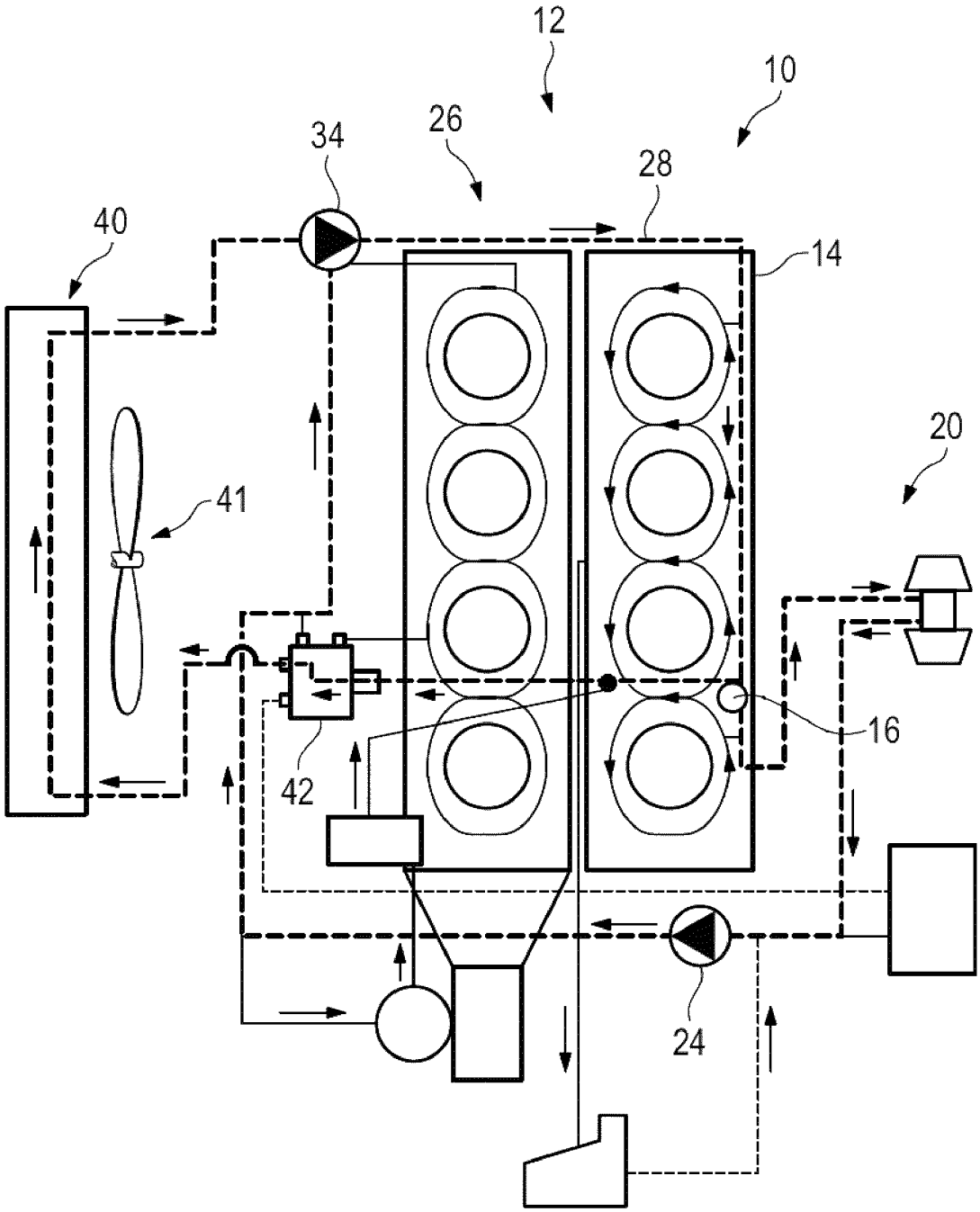
FIG. 4 is a schematic overview of a cooling system after engine shut-down according to an embodiment of the invention in the case of an internal combustion engine according to a second embodiment.

Particularly effective cooling of the described components is achieved if, in cooling system 22 after engine shut-down, a coolant cooler 40, for example in the form of an air-coolant heat exchanger, is incorporated in series or at least piecewise parallel to coolant duct 26 and at least a partial volume flow of the coolant flows through said coolant cooler (see FIG. 4).

The additional cooling effect of coolant cooler 40 on the coolant and therefore also on the components to be cooled can be further increased for example by the operation of a, in particular electric, fan 41 after the hot shut-down of internal combustion engine 10. Through the operation of pump 24, at least a partial volume flow of the coolant is pumped through coolant cooler 40, which is additionally cooled by the operation of fan 41 and thus enables more efficient cooling of the components to be cooled, in particular fuel pump 16 and exhaust gas turbocharger 20 and/or cylinder head 14.

Figure 2:
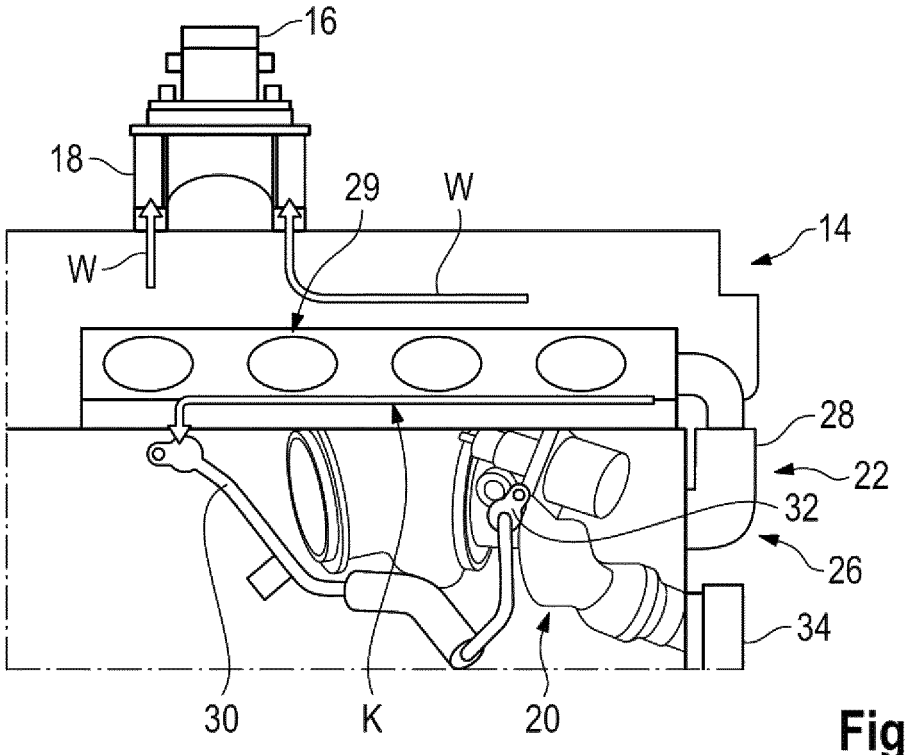
FIG. 2 is a cross-sectional representation of a part of the internal combustion engine from FIG. 1.

The sequence in which the coolant flows through the components to be cooled is represented here only by way of example and can be selected arbitrarily. For example, the flow direction of the coolant represented schematically in FIGS. 2 to 4 with the aid of the arrows can also be reversed into the opposite direction, so that for example, proceeding from pump 24, exhaust gas turbocharger 20 is first cooled and then fuel pump 16.

Since no additional components are required, cooling system 22 after engine shut-down, with which fuel pump 16 and exhaust gas turbocharger 20 are cooled, is constituted in a particularly cost-effective manner, since only components already used, which serve for the cooling after engine shut-down of exhaust gas turbocharger 20, are relied on.

In addition, no additional electronic components are required, since the already provided electronic components of the cooling system after engine shut-down of exhaust gas turbocharger 20 merely have to be adapted.

Moreover, costly ventilation measures in cooling system 22 after engine shut-down can be dispensed with, since fuel pump 16, in the installed state of internal combustion engine 10, lies above the components of cooling system 22 after engine shut-down, as a result of which a siphon formation in cooling system 22 after engine shut-down is prevented.

Furthermore, with cooling system 22 after engine shut-down or cylinder head 14, an additional cooling function is created for thermally highly stressed regions of cylinder head 14, for example exhaust valve crosspieces.

A particularly advantageous implementation according to the invention emerges if the cooling of the components takes place in a demand-based manner. The maximum individual cooling requirement in each case of the respective components to be cooled must be met herein by cooling system 22 after engine shut-down.

Such an individual cooling requirement consists, for example, of a combination of a control duration and a control intensity, e.g. for the variation of the delivered coolant volume flow, of pump 24, of a control duration and control intensity, e.g. for the variation of the speed, of a fan 41, as well as of a control duration and control signal of any further switchable components in cooling system 22 after engine shut-down, for example of an electrically switched actuator 42 (see FIG. 4).

The determination of the individual cooling requirement of a component can take place for example by means of an empirical or physical model, for example in the form of a model of the maximum temperature of the component for the time interval after a possible shut-down of internal combustion engine 10, which is stored in the engine control unit.

For example, the need for and the magnitude of an individual cooling requirement of for example fuel pump 16 or exhaust gas turbocharger 20 can be determined from variables of the current engine operation, e.g. current coolant temperature, current oil temperature, current engine power averaged over a specific period, current ambient temperature etc.

If the need for cooling after engine shut-down of at least one component results therefrom, cooling system 22 after engine shut-down is activated during the shut-down of internal combustion engine 10 and operated in a demand-based manner corresponding to the maximum individual cooling requirement of all the components to be cooled.

The energy consumption required by cooling system 22 after engine shut-down can thus be correspondingly minimized.

A cooling system 22 after engine shut-down and a cylinder head 14 are thus easily created, with which active cooling of fuel pump 16 can be guaranteed in an efficient and cost-effective manner.

The foregoing disclosure has been set forth merely to illustrate the invention and is not intended to be limiting.

Since modifications of the disclosed embodiments incorporating the spirit and substance of the invention may occur to persons skilled in the art, the invention should be construed to include everything within the scope of the appended claims and equivalents thereof.

What is claimed is:

1. A cooling system after engine shut-down, comprising:

a pump;

at least one component to be cooled; and a coolant duct for a coolant and the at least one component to be cooled, wherein the coolant duct is assigned to a fuel pump;

wherein the at least one component to be cooled is a cylinder head, wherein the fuel pump is fastened to the cylinder head by a holding fixture, and wherein the coolant duct extends through the holding fixture.

2. The cooling system after engine shut-down as claimed in claim 1, wherein another component to be cooled is an exhaust gas turbocharger.

3. The cooling system after engine shut-down as claimed in claim 1, further comprising:

a coolant cooler provided in the cooling system after engine shut-down at least piecewise parallel to or in series with the coolant duct.

4. The cooling system after engine shut-down as claimed in claim 3, further comprising:

a fan assigned to the cooling system after engine shut-down.

5. The cooling system after engine shut-down as claimed in claim 1, further comprising:

a fan assigned to the cooling system after engine shut-down.

6. A cylinder head for an internal combustion engine, through which a part of the coolant duct of a cooling system after engine shut-down as claimed in claim 1 extends.

7. A method for operating a cooling system after engine shut-down comprising a pump and a coolant duct extending through a holding fixture for a coolant and at least one component to be cooled, wherein the at least one component to be cooled is a cylinder head and a fuel pump is fastened to the cylinder head by the holding fixture, the method comprising the an act of:

controlling an operation of the pump of the cooling system after engine shut-down occurs.

8. The method as claimed in claim 7, wherein the act of controlling the operation of the pump is based on a known variable of an engine control unit.

9. The method as claimed in claim 8, wherein the known variable is a minimum cooling requirement of the at least one component to be cooled and of the fuel pump.

10. The method as claimed in claim 7, wherein the cooling system after engine shut-down further comprises a fan and the method further comprising the act of operating the fan based on, a determined demand-based control.

11. The method as claimed in claim 10, wherein the determined demand-based control is based on a known variable of an engine control unit.

12. The method as claimed in claim 11, wherein the known variable is a minimum cooling requirement of the at least one component to be cooled and of the fuel pump.

13. The method as claimed in claim 7, further comprising the act of:

switching at least one switchable actuator assigned to the cooling system after engine shut-down during operation of the cooling system after engine shut-down so as to adapt a cooling effect for the at least one component to be cooled and/or the fuel pump.

* * * * *